United States Patent [19]

Souliere

[11] 4,254,528

[45] Mar. 10, 1981

[54] CHIMNEY SWEEPING DEVICE

[76] Inventor: Andre A. Souliere, 219 West St., Biddeford, Me. 04045

[21] Appl. No.: 35,417

[22] Filed: May 2, 1979

[51] Int. Cl.[3] ..... F23J 3/02

[52] U.S. Cl. ..... 15/163; 15/243

[58] Field of Search ..... 15/162, 163, 242, 243

[56] References Cited

U.S. PATENT DOCUMENTS

| | | | |
|---|---|---|---|
| 213,473 | 3/1879 | Toyson | 15/243 |
| 1,500,886 | 7/1924 | Nelson | 15/163 |
| 2,284,391 | 5/1942 | Hefle | 15/163 |
| 2,290,467 | 7/1942 | Fleming | 15/162 |

*Primary Examiner*—Edward L. Roberts

[57] ABSTRACT

A chimney sweeping device is adapted to be suspended by a line in a chimney flue with a weight attached thereto thus to enable the device to be reciprocated in the flue. The cross sectional dimensions of chimney flues vary and the devices have two sets of bristles interconnected to enable the distance between them to be adjusted as required to ensure proper bristle engagement with two opposite flue walls. Each set of bristles includes two bristle units and these are interconnected to enable the sets to be extended or shortened as required by the width of the two opposite walls next to be cleaned.

12 Claims, 5 Drawing Figures

Fig. 3
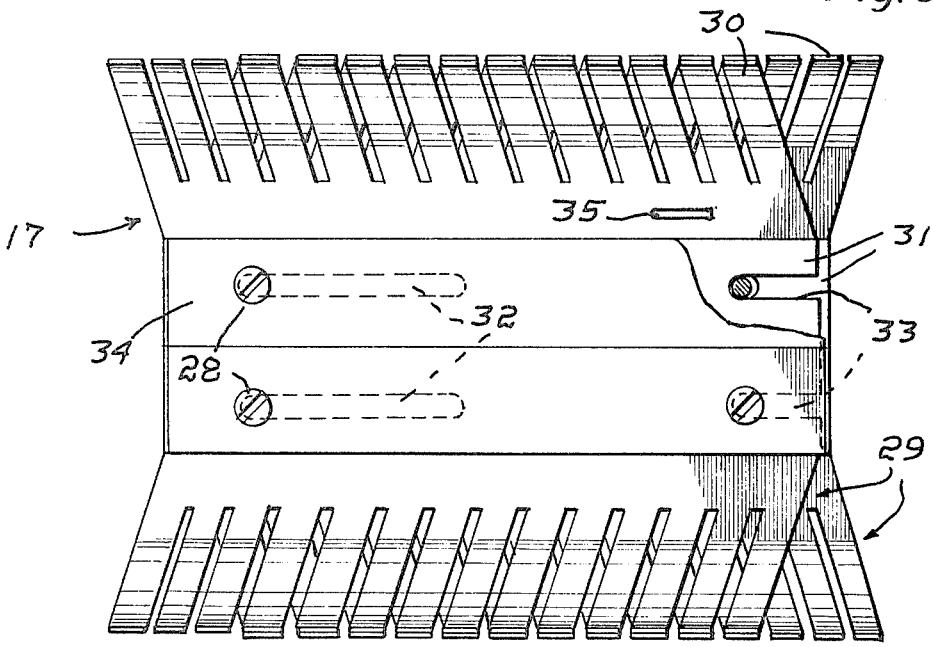
Fig. 4
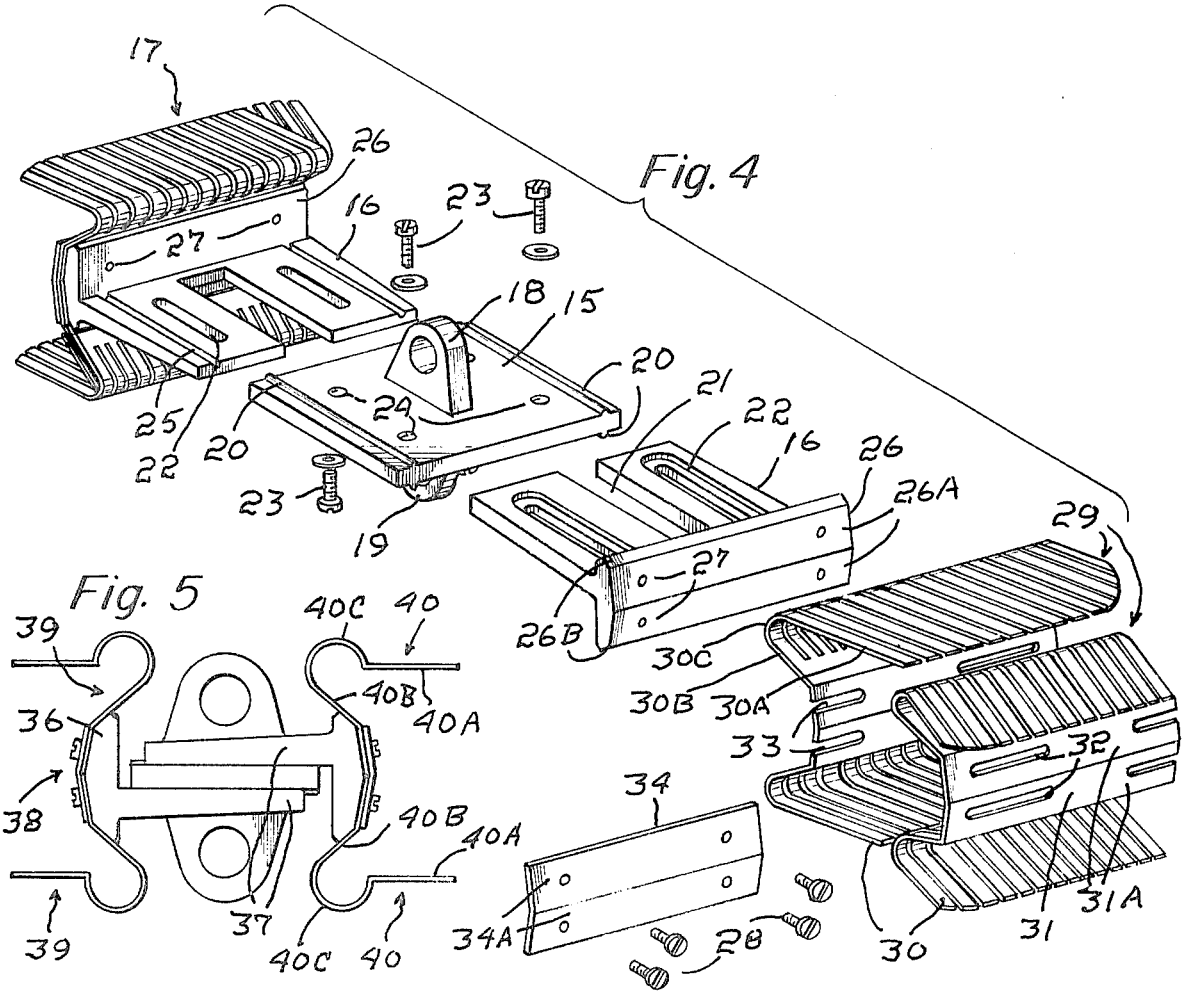
Fig. 5

CHIMNEY SWEEPING DEVICE

BACKGROUND REFERENCE

U.S. Pat. No. 2,290,467.

BACKGROUND OF THE INVENTION

The sweeping of chimneys was commonly practiced in earlier years and the increased use of wood as a fuel at the present time has again made desirable the periodic cleaning of chimney flues to minimize the risk of fires.

As far as I am aware, there are no chimney sweeping devices that are capable of being adjusted for use with flues of different cross sectional dimensions and that are also adapted to be easily used to free the chimneys of potentially dangerous soot and creosote deposits.

THE PRESENT INVENTION

The general objective of the present invention is to provide chimney cleaning devices that not only are efficient and easy to use but also are adjustable for use in cleaning flues within a substantial range of cross sectional dimensions.

In accordance with the invention, this objective is attained with a device having a support to be suspended in a chimney and two transverse sets of bristles connected to opposite sides of the support for sweeping engagement with opposite flue walls with at least one and preferably both sets adjustable relative to the support as required by the distance between the walls to ensure such engagement therewith as will cause the bristle to flex as the device is lowered and raised. Desirably the device is of such light weight that an additional weight must be connected thereto to ensure its descent when the suspending means is a line.

Each bristle set consists of two transverse units each of which contains a series of interconnected bristles of tempered steel and is connected to the support to enable one and preferably both units to be moved transversely relative to the support to enable each set to be extended or shortened as required by the width of the opposite flue walls next to be swept. Preferably the bristle units of each set are identical.

Another objective is to ensure sweeping efficiency, an objective attained with each bristle unit having two vertically spaced series of bristles.

Another objective of the invention is to ensure maximum effectiveness of the bristles as they are flexed, an objective attained with the bristles of each unit having portions connected to and extending inwardly and away from the support portions that extend outwardly with flue wall engaging extremities, and intermediate curved connecting portions facilitating the change in the direction of bristle flexing when the direction of travel of the device in a flue is reversed.

Another objective of the invention is to provide means to connect the bristle sets to the support in a manner placing corresponding bristle series of both sets in transverse alignment, an objective attained with two identical holders, one for each bristle set and with the support having upper and lower surfaces to each of which the appropriate one of the two holders is connected in a manner enabling it to be adjusted relative thereto and locked in its adjusted position in which the bristle sets are spaced as required by the distances between the two flue walls to be cleaned.

Each holder has a lengthwise head to which the bristle units are connected with the longitudinal center line between their upper and lower series of bristles so spaced relative to the surface of the holder which is to engage a surface of the support that each holder may be secured to the appropriate surface of the support with the center lines of the units of both sets in the same transverse plane.

BRIEF DESCRIPTION OF THE DRAWINGS

The accompanying drawings illustrate preferred embodiments of the invention and

FIG. 3 is a section, on the scale of FIG. 2, taken approximately along the indicated line 3—3 of FIG. 1;

FIG. 4 is an exploded view of the device; and

FIG. 5 is an end view of bristle units in accordance with another embodiment of the invention.

THE PREFERRED EMBODIMENTS OF THE INVENTION

Figure 1:
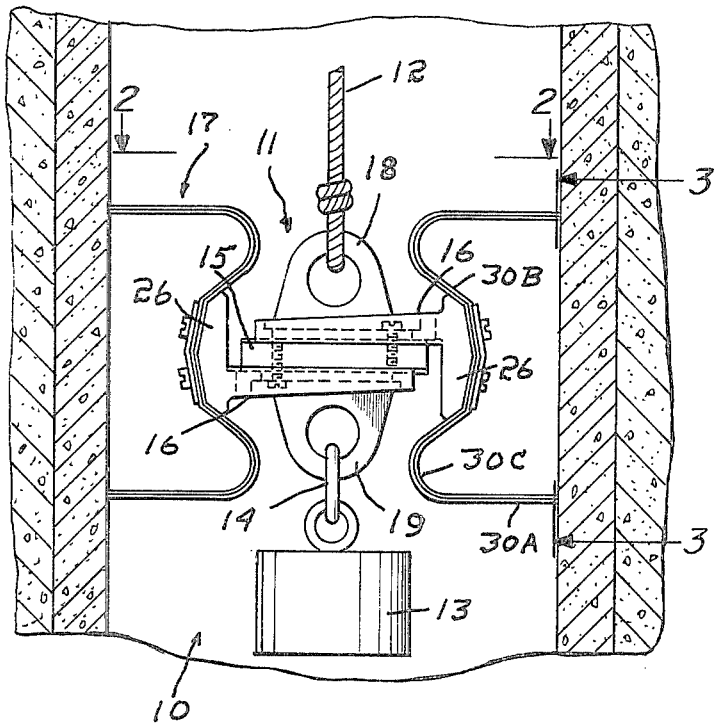
FIG. 1 is a vertical section of a chimney flue with a chimney sweeping device suspended therein.

A chimney flue to be cleaned is generally indicated at 10. The cross sectional shapes of the flues of houses vary from square to oblong and may, for example, be six inches by six inches, eight by eight, eight by twelve, or twelve by twelve. In each case, however, the actual inside dimensions are typically somewhat less.

A chimney sweeping device is generally indicated at 11 and is adapted to be suspended in the flue 10 by a line 12. In order to minimize transportation costs, each holder 11 is so light in weight that for its reciprocation a weight 13 is secured to its undersurface as by a link 14.

The device includes a support consisting of a flat surfaced central part 15 and two identical holders 16. Each holder 16 carries a bristle set generally indicated at 17 and is disposed to position the bristle sets for engagement with opposite flue walls.

Figure 2:
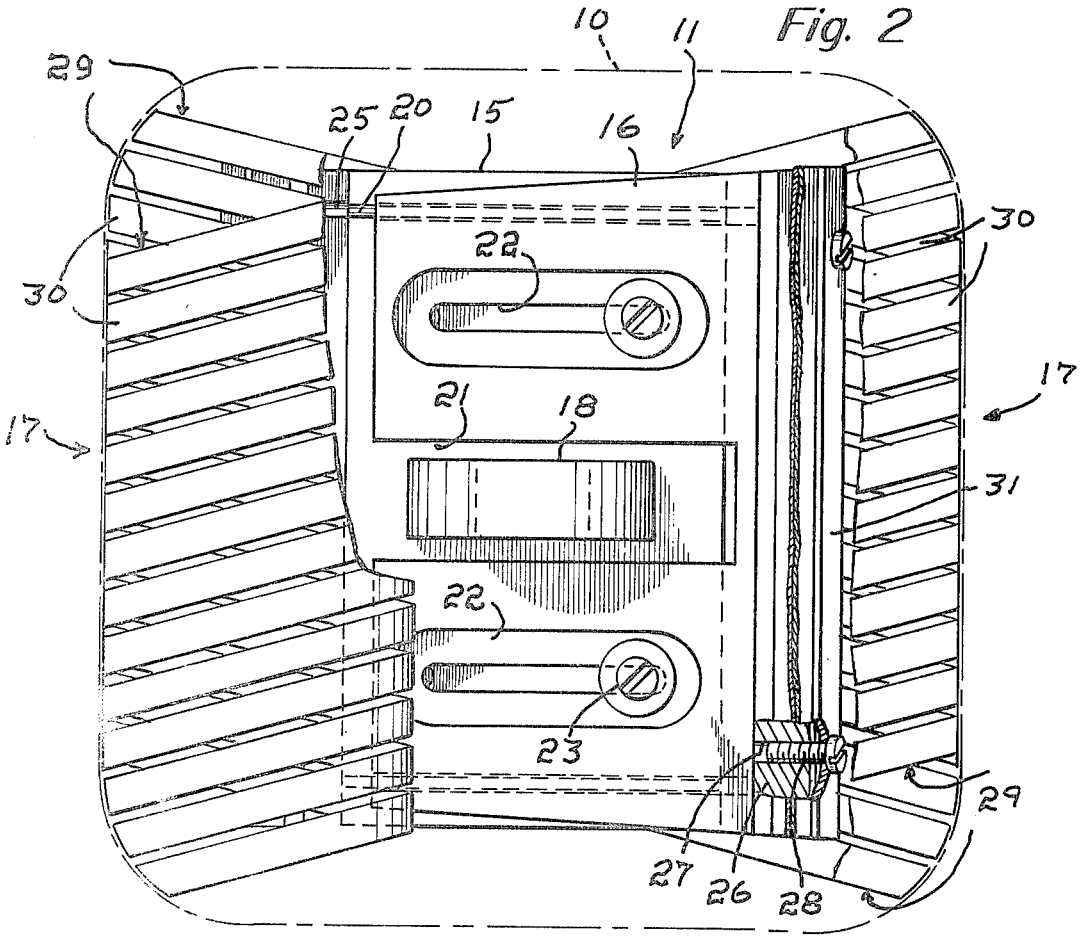
FIG. 2 is a section, on an increase in scale, taken approximately along the indicated line 2—2 of FIG. 1.

The central part 15 is provided with a centrally located eye 18 for the line 12 on its upper surface and a centrally located eye 19 on its undersurface for the link 14. Adjacent each of the side margins of both surfaces of the part 15 are ribs 20. See FIGS. 2 and 4.

One holder 16 is slidably connected to the undersurface of the central part 15 and the other holder is slidably connected to the upper surface thereof. To effect such connections, each holder 16 has a central open-ended slot 21 to accommodate the appropriate one of the eyes 18, 19, and parallel countersunk slots 22, one on each side of the slot 21 and located to enable connecting screws 23 to be entered therethrough and threaded in sockets 24 in the central part 15 thus enabling both holders 16 to be moved towards or away from each other. Each holder has channels 25 receiving the ribs 20 on the surface of the central part 15 to which it is connected.

Each holder 16 includes a lengthwise head 26 to which a bristle set is connected and has, see FIG. 4, lengthwise, angularly inwardly disposed portions 26A with the apex providing a lengthwise center line, and similarly disposed marginal portions 26B. The portions 26A have threaded sockets 27 for screws 28. In order that the center lines of the two heads 26 when their holders 16 are inverted and attached to opposite surfaces of the central part 15 in the manner best seen in FIG. 1, will be in a plane inclusive of the geometric center thereof, each head 26 is so offset relative to its holder 16 as to space the head center line appropriately for that purpose.

Each bristle set 17 consists of two identical bristle units 29 of tempered spring steel and having an upper and lower series of narrow, closely spaced, resilient bristles 30 interconnected by a web 31. Each web 31 has portions 31A corresponding to and fitting against the head portions 26 and provided with slots 32 adjacent one end and slots 33 opening through its other end. The two units 29 of each bristle unit are assembled, one reversed relative to the other and fitted therein. A clamping member 34 has angular disposed portions 34A corresponding to the head portions 26A and provided with screw holes which and the slots 32 and 33 are so spaced as to enable the screws 28 to be entered therethrough and threaded into the head sockets 27. The bristle sets 17 are thus connected to the holders in a manner enabling the two bristle units 29 to be moved lengthwise in opposite directions either to lengthen or shorten the set as required by the width of the two opposite walls of the flue 10 that are then to be brushed and the bristle units 29 then securely locked in their selected positions. The length of each unit 29 is such that at all times the bristle units of each set 17 at least partially overlap.

Each bristle 30, see FIG. 4, includes a straight, outwardly extending portion 30A, a portion 30B joined to the web 31, seated against the marginal head portions 26B and extending inwardly away with respect to the web, and an intermediate connecting portion 30C which is so curved as to bring parallel the outer portions 30A of the upper and lower series of bristles with the outer portions tangential to a circle of the radius of the portion 30C, see FIG. 1. The inner portions 30B of the bristles yield inwardly as the direction of travel of a device 11 is reversed.

From the foregoing, it will be apparent that the distance between the two bristle sets 17 may be quickly and easily adjusted to ensure proper bristle engagement with opposite flue walls since it is only necessary to turn the screws 23 to so loosen the holder 15 that they may be slid into their wanted positions with the ribs 20 and channels 25 interengaged and the screws 23 then tightened.

When an adjustment in the length of the bristle sets 17 is necessary, the screws 28 are loosened to an extent enabling either one or both units 29 to be slid lengthwise to a wanted extent and then locked by again tightening the screws. When each set has its units 29 positioned so that it is of minimum length, one unit 29 is so nearly covered by the other that the portion 30A of each unit 29 is provided with a slot 35 which enables a screw driver to be used at least to so separate the units 29 that either one or both may be easily gripped and pulled lengthwise to the wanted extent.

With the bristle sets and bristle units adjusted to ensure effective engagement of the bristles 30 with opposite flue walls and with the weight 13 and the line 12 attached to the support 15, the device is lowered in a flue 10 and raised and lowered to dislodge soot and creosote from the engaged flue wall and it is then so turned as to permit the remaining two walls to be similarly swept making similar adjustments in bristle set spacing and length if necessary.

In the embodiment of the invention illustrated by FIG. 5, the heads 36 of the holders 37 are or may be identical to the corresponding parts of the device illustrated by FIGS. 1–4 and are, accordingly, not detailed. The bristle sets 38 consist of two identical bristle units 39 of tempered spring steel and connected to the heads 36 in the previously described manner. Each bristle unit 39 is shown as having but one series of bristles 40 which, like the bristles 30 are narrow, closely spaced, thin and resilient, but which differ therefrom in that the curved portion 40C of each bristle, between its straight outwardly extending and flue wall engaging portions 40A and the web connected portion 40B defines a major arc with the bristle portion 40A, in a plane inclusive of the center of a circle of the radius of the bristle portion 40C providing a more effective brushing action. Each unit 39 is of sufficient length so that when two such units are attached to a holder head 36, one reversed relative to the other, the two series of bristles at least partially overlap in any selected adjustment of a bristle set 38.

I claim:

1. A device for use in sweeping chimney flues the cross sectional areas of which are within a predetermined range, said device to be suspended by a line in and moved vertically in such a flue, said device including a support, two sets of bristles, one for each of two opposite sides of said support, each set including two bristle units of substantial length and of tempered steel, each unit including a web and a series of integral bristles extending along at least one margin outwardly therefrom relative to the support, said support also including transverse holders, one at each of said two sides thereof, means connecting the webs of the two units of each set lengthwise to the appropriate one of said holders with end portions of the webs and bristle series overlapping and with at least the overlapping portions of the webs in mutual contact, said means operable to enable the effective length of each set to be adjusted as required by the transverse dimensions of the wall to be cleaned, and at least one of said holders adjustable relative to said support to enable the distance between said bristle sets to be varied to effect engagement of said bristles with each opposite walls, and means connected to said support to which the line is attachable with the two sets then held horizontally when suspended thereby.

2. The device of claim 1 in which each bristle includes an outwardly extending portion the extremity of which is to engage a flue wall, an a portion joined to the web and extending in the opposite direction and away from said support and an intermediate connecting portion enabling the bristles readily to shift their flexed direction when the direction of travel of the device is reversed.

3. The device of claim 1 in which the overlapping portions of the bristle series are in mutual contact.

4. The device of claim 1 in which each bristle includes an outwardly extending portion the extremity of which is to engage a flue wall, an inner portion joined to the web and extending inwardly with respect thereto, and an intermediate connecting portion, said inner portions yielding inwardly as the direction of travel of the device is reversed.

5. The device of claim 4 in which the intermediate portion of each bristle is arcuate.

6. The device of claim 5 in which the intermediate portion of each bristle defines a major arc and the outwardly extending portion is in a plane intersecting the arc approximately at its center.

7. The device of claim 1 in which there is also a series of bristles extending along the other margin of the web.

8. The device of claim 1 in which the bristle units are identical and are so shaped and dimensioned that they may be assembled one within the other with their webs in mutual contact, said webs having slots which then at least partially register and through which they are screw-attached to the support.

9. The device of claim 1 in which the support includes a flat surfaced central part, and means connecting each holder to said central part for sliding movement towards or away from the other holder and operable to lock each holder to said support in any selected position relative thereto.

10. The device of claim 9 in which one holder is connected to the undersurface of the central part and the other holder is connected to the upper surface thereof, the central part includes centrally located eyes, one on the upper surface of the central part and one on the undersurface thereof, each holder has a central slot accommodating the appropriate one of the eyes, and the connecting means for each holder includes interengaged ribs and channels on the proximate surfaces of the holder and central part and screws extending through slots, one on each side of such central slots and operable to release the holder for movement relative to the support and to lock that holder in a selected position relative thereto.

11. The device of claim 10 in which the holders are identical and each includes a longitudinal head to which a bristle set is connected, each head having a lengthwise center line spaced vertically from the geometric center of the holder, each holder inverted relative to each other in positions such that when connected to the central part of the support bring corresponding edges of the heads in transverse alignment and the center lines of the heads in a plane inclusive of said center.

12. The device of claim 11 in which the head sections of each holder include lengthwise angularly disposed portions defining said center line and each bristle unit includes a web having angularly disposed portions corresponding to said head portions and connected thereto for adjustments lengthwise thereof and bringing corresponding bristle series of the two sets in transverse alignment.

* * * * *